United States Patent [19]

Watanabe et al.

[11] Patent Number: 4,550,302

[45] Date of Patent: Oct. 29, 1985

[54] SOLENOID

[75] Inventors: Shuichi Watanabe, Neyagawa; Noboru Katakabe, Uji, both of Japan

[73] Assignee: Matsushita Electric Industrial Co., Ltd., Japan

[21] Appl. No.: 548,135

[22] Filed: Nov. 2, 1983

[30] Foreign Application Priority Data

Nov. 9, 1982 [JP] Japan ..... 57-196432
Jan. 20, 1983 [JP] Japan ..... 58-8417

[51] Int. Cl.[4] ..... H01F 7/08

[52] U.S. Cl. ..... 335/228; 335/234; 335/256

[58] Field of Search ..... 335/228, 229, 230, 234, 335/256; 310/20, 23, 37

[56] References Cited

U.S. PATENT DOCUMENTS 2,690,529 9/1954 Lindblad ..... 335/228
3,883,839 5/1975 Barrett et al. ..... 335/228 X
3,940,642 2/1976 Glaser ..... 335/228

*Primary Examiner*—George Harris
*Attorney, Agent, or Firm*—Wenderoth, Lind & Ponack

[57] ABSTRACT

A solenoid including a plunger supported on a shaft so as to be axially and rotatably moveable, a rotator rotatably supported on the shaft, a coil for generating magnetic flux to attract the plunger to the rotator by a magnetic force, and yokes for completing magnetic circuits such that the plunger and rotator are subjected to no radial force by the magnetic force and no axial force after they are drawn to each other.

10 Claims, 9 Drawing Figures

SOLENOID

BACKGROUND OF THE INVENTION

1. Field of the Invention

This invention relates to a solenoid suitable for driving a print element or the like of a printing apparatus such as an electronic typewriter.

2. Description of the Prior Art

For moving a rotary object in the direction of its axis of rotation, a combination of a solenoid and a link has hitherto been used. Since the rotary object always contacts with a stationary member such as the link, the frictional force increases the load and the wear causes looseness, which results in poor reliability.

SUMMARY OF THE INVENTION

An object of the invention is to provide a solenoid which is capable of moving a rotary object directly axially and the object is imparted with less frictional and inertial forces so as to enable operation by less drive energy.

The solenoid of the invention is provided with a rotator including a magnetic material rotatably mounted on a shaft, a plunger rotatably mounted on the shaft and axially movable between a first position where the plunger is apart from the rotator at a predetermined spacing and a second position where the same abuts against or is close to the rotator, a yoke comprising a magnetic material and disposed to be close, at least in part, to the rotator and plunger, respectively, so that a magnetic circuit inclusive of the rotator and plunger is formed, a support member which supports the rotator and plunger coaxially with each other and apart from the yoke, at the predetermined spacing, and a magnetic flux generating means which, when energized, generates the magnetic flux in the magnetic circuit and including a coil for moving the plunger from the first position to the second position by magnetic attraction, the rotator and yoke and the plunger and yoke being opposite at the surfaces thereof to the support member and parallel thereto, the opposite portions being made symmetrical with respect to the support member so that the plunger can support a driven object (a print element or the like of a printing apparatus) rotatably and movably in the direction of the axis of rotation of the driven object.

BRIEF DESCRIPTION OF THE DRAWINGS

The above and other objects and features of the invention will become more apparent in the following detailed description taken in connection with the accompanying drawings in which.

DESCRIPTION OF THE PREFERRED EMBODIMENT

Next, the embodiment of the invention will be described with reference to the accompanying drawings.

Figure 1:
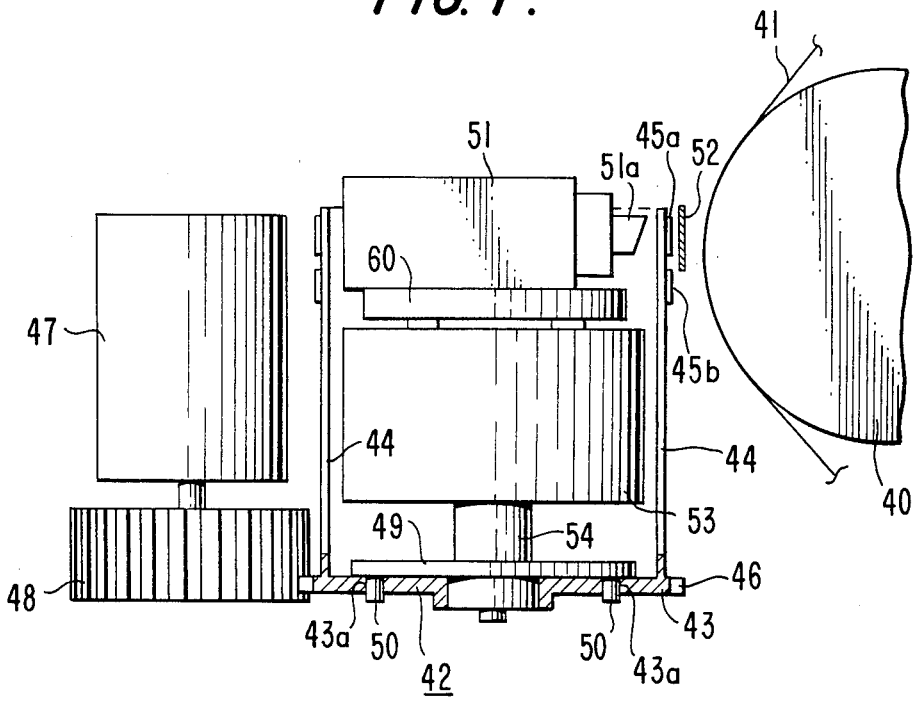
FIG. 1 is a side view of a principal portion of an embodiment of a solenoid of the invention, which is used in a printing apparatus.

FIG. 1 is a side view of the principal portion of the solenoid of the invention when used for a printing apparatus, in which reference numeral 40 designates a platen for holding print paper 41, and reference numeral 42 designates a print element. The print element 42 comprises a plurality of spokes 44 extending vertically from a position near the outer periphery of a disc base 43 at regular intervals, each spoke 44 having outside the utmost end types 45*a* and 45*b* disposed vertically in two rows. The outer periphery of disc base 43 of the print element 42 is toothed to form a gear 46 to engage with a gear 48 fixed to a rotary shaft of a motor 47. The disc base 43 is provided with bores or cutouts 43*a* into which are inserted projections 50, such as pins, projecting from a type mounting member 49, the print element 42 and type mounting member 49 being integral with each other and rotatable and vertically movable.

At the rear side of type 45*a* (or 45*b*) is positioned an actuator 51*a* of a printing hammer 51 provided on a fixed base 60. The hammer 51, when given a signal, allows the actuator 51*a* to project rightwardly in FIG. 1 to push the type 45*a* or 45*b* toward the print paper 41. Then, since the spoke 44 has a proper elasticity, the type 45*a* or 45*b* is pressed onto the print paper 41, thus carrying out the printing because a print ribbon 52 is provided between the type 45*a* or 45*b* and the print paper 41.

Reference 47 designates a motor for controlling the rotary position of print element 42, the motor 47 being controlled in its rotary position by a control circuit (not shown). The gear 48 mounted to the motor 47 is thick enough to keep engagement with the gear 46 even when the print element 42 vertically shifts. Reference numeral 53 designates a solenoid for vertically moving the print element 42. The solenoid 53, when given a shift signal, attracts and moves upwardly by an electromagnetic force, a plunger 54 carrying at the lower end thereof the type mounting member 49. Hence, the print element 42, as shown in FIG. 1, is raised from the position where the upper type 45*a* is opposite to the utmost end of actuator 51*a* of the hammer 51 (to be hereinafter called the first position) to the position where the lower type 45*b* is opposite to the utmost end of the same (to be hereinafter called the second position).

Figure 2:
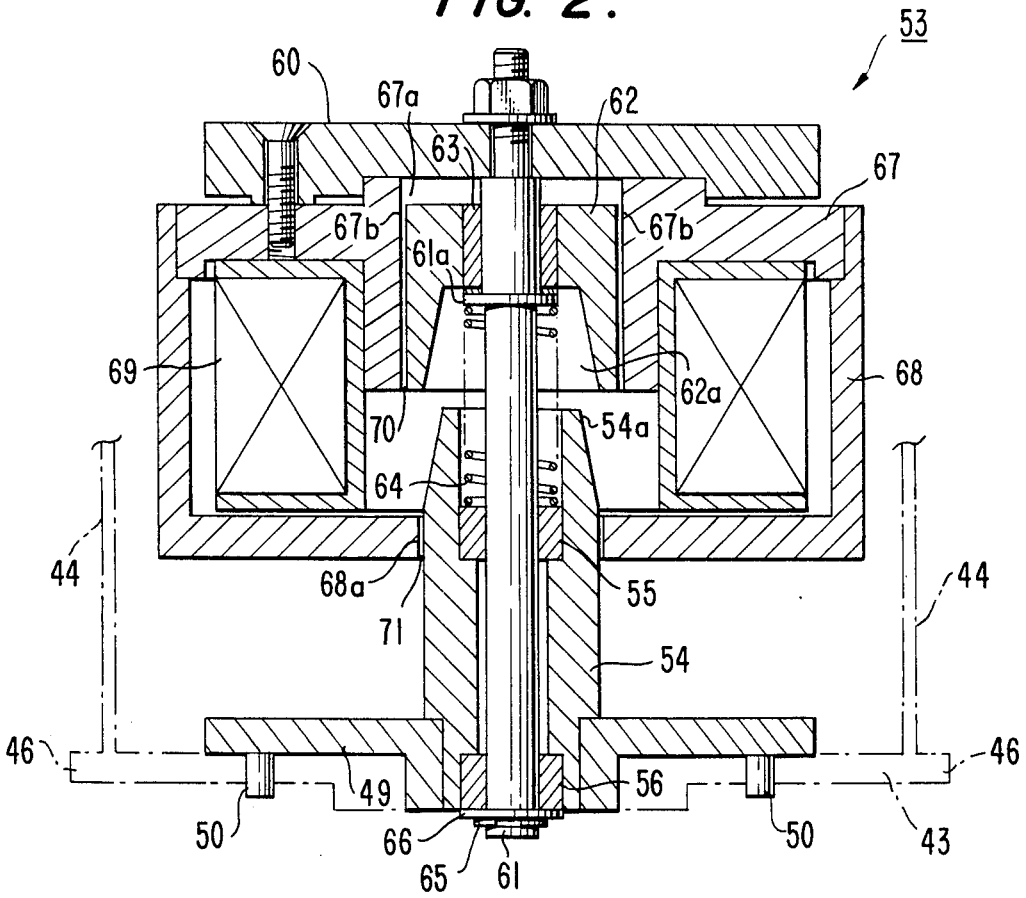
FIG. 2 is a sectional side view of the embodiment of the solenoid of the invention.

FIG. 2 is a sectional view of an embodiment of the solenoid of the invention, which is effective for use. A supporting shaft 61 is fixed to the center of fixed base 60 and supports a cylindrical rotator 62 and a cylindrical plunger 54 in vertically spaced relation thereon. The rotator 62 is made from a magnetic material and a slide bearing 63 is press-fitted into the central portion of rotator 62, thereby enabling the rotator 62 to freely rotate along the shaft 61. Also, the rotator 62, which is axially movable, normally rests stationary on a flange 61*a* provided on the shaft 61. The plunger 54 also is formed of magnetic material, and slide bearings 55 and 56 are press-fitted into the axially central portions of plunger 54, whereby the plunger 54 is rotatable and axially movable. A coil spring 64 is interposed between the plunger 54 and the flange 61*a* at the shaft 61 so as to bias the plunger 54 downwardly to thereby urge the print element 42 to the first position. In addition, the plunger 54 is stationary at the position where a biasing force of coil spring 64 allows the plunger 54 to abut at the lower end thereof against an E-ring mounted to the shaft 61.

Since a slider washer 66 at the above position is sandwiched between the slide bearing 56 and the E-ring 65, the plunger 54 can rotate with very small rotational resistance.

The plunger 54 is upwardly tapered at the upper portion 54*a*, and the lower portion of rotator 62 opposite to the upper portion 54*a* of plunger 54 is formed with a recess 62*a* shaped to mate with the tapered upper portion 54*a*. Yokes 67 and 68 of magnetic material are formed in an about downward-U-like shape and an upward-U-like shape in section, respectively, and disposed and connected in a manner of embracing a coil 69, the yoke 67 containing in the central cylinder the rotator 62 in a relation of not contacting with the yoke 67, and having a through bore 67*a* large enough that the rotator 62 can have a recess 62*a* large enough to receive the upper portion 54*a* of plunger 54. The through bores 67*a* and 68*a* in the yokes 67 and 68 are opposite at the inner peripheries to the outer peripheries of rotator 62 and plunger 54 and define proper gaps 70 and 71 between the respective outer peripheries of the rotator 62 and the plunger 54 and the inner peripheries of the yokes 67 and 68.

Here, the rotator 62 and yoke 67 and the plunger 54 and yoke 68 are opposite to each other at the surfaces parallel to the shaft 61 through the gaps 70 and 71, respectively, and these opposite portions are symmetrical with respect to the shaft 61.

When the coil 69 is energized, the magnetic circuit of yokes 68 and 67, rotator 62 and plunger 54, generates a magnetic flux so that the plunger 54 is attracted to the rotator 62 by magnetic attraction so as to move the plunger 54 and print element 42 an equal amount therewith.

Figure 3:
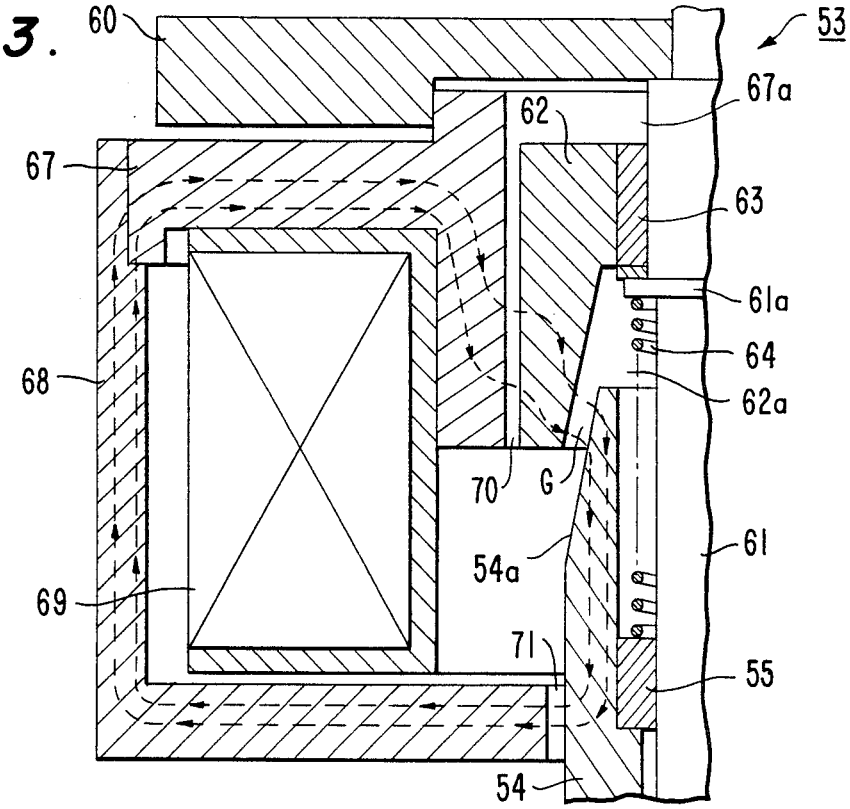
FIG. 3 is a partially enlarged view explanatory of operation of the FIG. 2 embodiment.

FIG. 3 is a schematic view showing magnetic flux exemplary of that generated within the solenoid 53 when the coil 69 is energized, in which the magnetic flux is shown by the broken line. Since the magnetic flux passes through the gaps 70 and 71 perpendicularly to the surfaces of the plunger 54 and the rotator 62 and is uniform throughout the circular gaps 70 and 71, no force is generated radially of rotator 62 and plunger 54, but the magnetic flux passing through a gap G between the upper tapered portion 54*a* of the plunger 54 and the sloped surface of recess 62*a*, generates an axial strength to move the plunger 54 upwardly while compressing the coil spring 64, whereby the rotator 62 attracts the plunger 54. The attraction between the rotator 62 and plunger 54 is resisted by the spring 64 so as to stop at the position where the rotator 62 abuts against the flange 61*a* of the shaft 61, whereby the print element 42 is shifted always to the same position. Since no lateral pressure acts on the bearing even after the attraction, rotational resistance on plunger 54 is very small. Also, since the gap G becomes smaller after the attraction and magnetic reluctance is reduced, the exciting energy to hold attraction of plunger 54 is reducible, whereby the tapered portion of plunger 54 to be attracted, even when the gap G is larger at the beginning of attraction, requires not so much larger an exciting force.

Upon deenergizing the coil 69, the plunger 54 moves downwardly by its weight and action of coil spring 64 and is in a stand-by position where the lower end of plunger 54 hits the E-ring 65.

As seen from the above embodiment, the plunger coupled with the type mounting member for the print element is directly vertically movable and held in non-contact by the magnetic force. Also, the operating members are reduced in number to improve reliability and permit the apparatus to be small in size. Furthermore, the smaller rotational resistance and the smaller load inertia during the rotation of print element have the effect of reducing a load on the motor.

Incidentally, in the above embodiment, the motor and print element are connected by the gears in order to rotate the print element, but the invention is not so limited.

Figure 4:
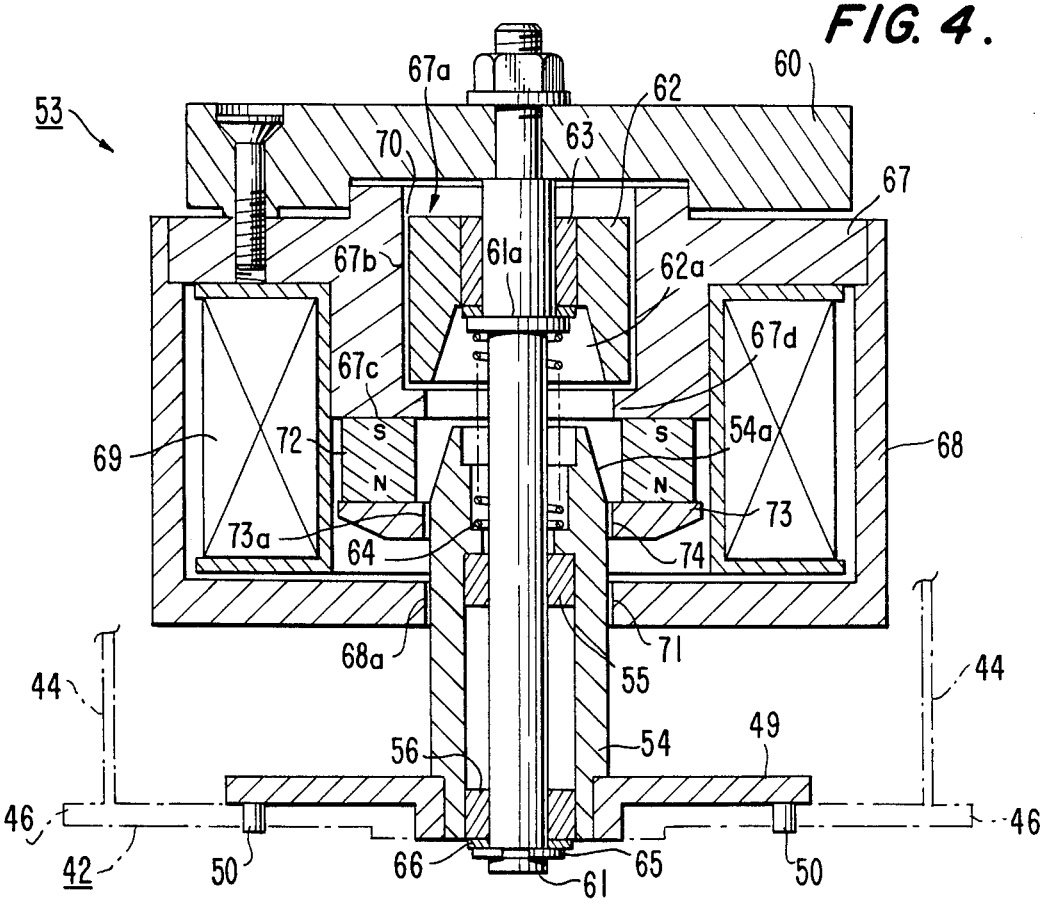
FIG. 4 is a sectional side view of a modified embodiment of the invention.

FIG. 4 is a sectional side view of a modified embodiment of the solenoid of the invention. Next, explanation will be given on the modified embodiment, in which the components functioning as the same as those in FIG. 2 are designated by the same reference numerals and duplicate explanation will be omitted herein. The FIG. 4 embodiment includes a cylindrical or a ring-like-shaped permanent magnet 72 fixed to the lower surface 67*c* of yoke 67. The permanent magnet 72 is magnetized thicknesswise and has at the lower surface a ring-like magnetic member 73 of magnetic material fixed thereto, the magnetic member 73 being opposite at the inner periphery 73*a* to the outer periphery of plunger 54 at a predetermined spacing 74.

Figure 5:
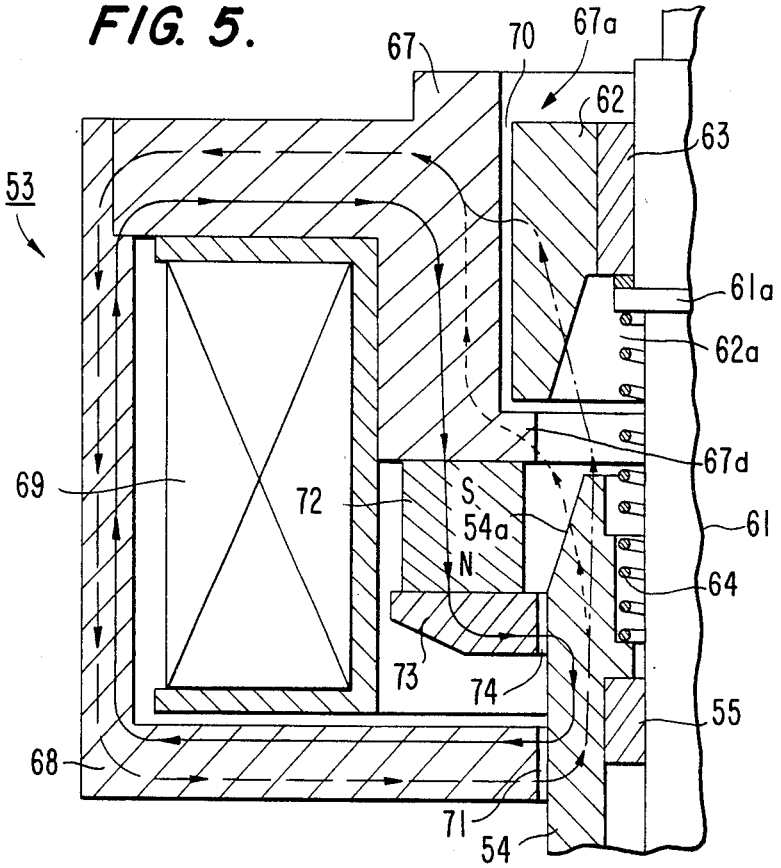
FIGS. 5 and 6 are partially enlarged side views explanatory of operation of the FIG. 4 embodiment.
Figure 6:
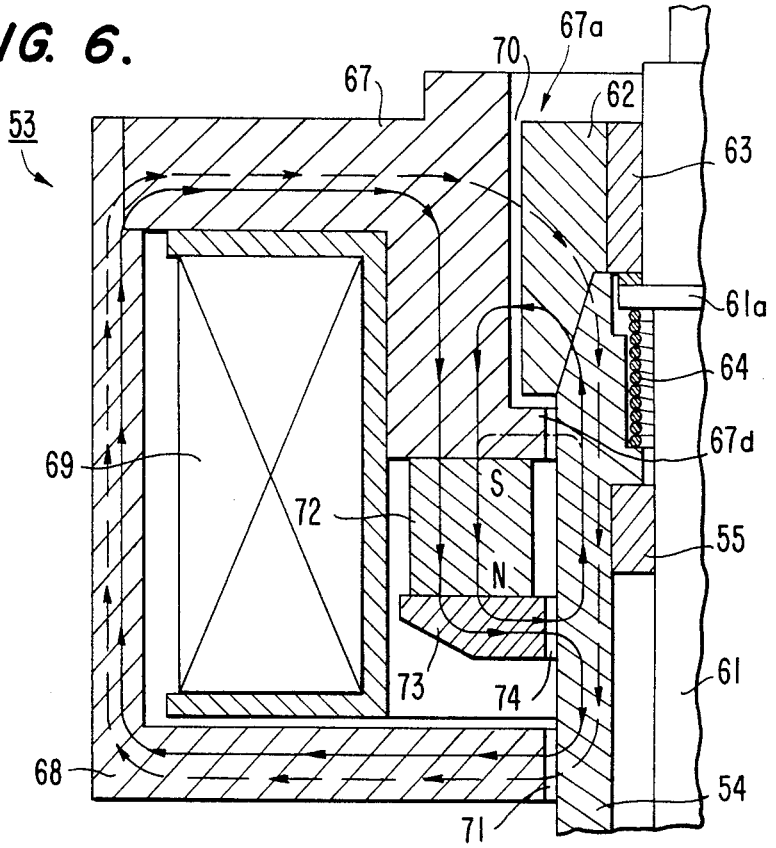

FIGS. 5 and 6 are schematic views exemplary of the magnetic flux generated within the solenoid 53 in FIG. 4, FIG. 5 showing the plunger 54 having moved downwardly toward the restoration position, FIG. 6 showing the same in the upwardly shifted position.

In FIG. 5, the magnetic flux generated by the permanent magnet 72 is represented by the solid line and that generated when the coil 69 is given a shift signal, by the broken line and one-dot chain line. When the plunger 54 is in the restoration position as shown in FIG. 5, a magnetomotive force of permanent magnet 72 generates the magnetic flux in the magnetic circuit of magnetic member 73-gap 74-plunger 54-gap 71-yoke 69-yoke 67, the magnetic flux passing through the gaps 74 and 71 being oriented radially of plunger 54, thereby not generating the force to axially move the plunger 54. In addition, the above magnetic flux causes a radial attraction for the plunger 54, but the gaps 71 and 74 ae axially symmetrical so that the attractions are cancelled with each other to give no radial force to the plunger 54. Hence, the slide bearings 55 and 56 for the plunger 54 are subjected to no lateral pressure, resulting in a very small rotational resistance against the plunger.

In the state of FIG. 5, when the coil 69 is given the shift signal, the magnetic flux is generated in the magnetic circuit of yoke 67-yoke 68-gap 71-plunger 54 and, initially the magnetic flux from the plunger 54, when the gap between the plunger 54 and the rotator 62 is larger, mostly passes the lower flange 67*d* of yoke 67, but not the rotator 62.

When the coil 69 is energized and the plunger 54 starts its upward movement to reduce the gap between the plunger 54 and the rotator 62, the magnetic flux from the plunger 54 passes through the rotator 62 and gap 70 to enter the yoke 67 as shown by the one-dot chain line in FIG. 5, and the magnetic flux passing through the plunger 54 and yoke flange 67*d*, or the plunger 54 and rotator 62, generating a force to axially move the plunger 54. In this case, the radial attractions for the plunger 54 also are cancelled with each other to thereby generate no lateral pressure, thus smoothing the rotation and axial movement of plunger 54.

Now, when the plunger 54 is fully attracted into contact with the rotator 62, the magnetomotive force of permanent magnet 72 will generate the magnetic flux as shown by the solid line in FIG. 6. The magnetic flux passing the magnetic circuit of permanent magnet 72-magnetic material 73-gap 74-plunger 54-rotator 62-gap 70-yoke 67-permanent magnet 72 allows the plunger 54 to be magnetically held to the rotator 62. At the same time magnetic flux also is generated in another magnetic circuit of permanent magnetic 72-magnetic material 73-gap 74-plunger 54-gap 71-yoke 68-yoke 67-permanent magnet 72, but no force is generated thereby in the plunger 54. This latter magnetic circuit is larger in magnetic reluctance than the former magnetic circuit, whereby the magnetomotive force of permanent magnet 72 mostly attracts the plunger 54 to the rotator 62. Hence, even when the coil 69 is deenergized, the plunger 54 is kept in the upwardly shifted condition so that the print element 42 is left in the second position.

In this case, upon applying to the coil 69 a return signal (in the reverse direction to the shift signal) for restoring the plunger 54, the magnetic flux as shown by the broken line in FIG. 6 is generated to cancel the magnetic flux passing from the plunger 54 to rotator 62 among those generated from the permanent magnet 72, and a part of the magnetic flux passing from the plunger 54 to rotator 62 detours to pass from the plunger 54 to yoke flange 67*d* as shown by the one-dot chain line. As the result, a plunger 54 is subjected to no axial attraction by permanent magnet 72 and therefore moves downwardly by its weight and action of coil spring 64 to be restored to the restoration position where it stops.

The coil 69 is energized as above-mentioned, so that the plunger 54 is electromagnetically attracted to the rotator 62, and after being so attracted, is kept in this attracted condition by the magnetomotive force. When the coil 69 is energized in the direction reverse to the shifting direction, the above attraction is released to restore the plunger 54. Accordingly, the coil 69 is given the shift signal and return signal to enable the print element 42 to move from the first position to the second position (to select the type 45*b*), and vice versa (to select type 45*a*).

The FIG. 4 embodiment is advantageous over the FIG. 2 embodiment in that particular electric energy is not required for holding the print element in the shifted position. Moreover, the magnetomotive force for reset can be smaller due to the bypass included in the magnetic circuit when the shifting is reset.

Figure 7:
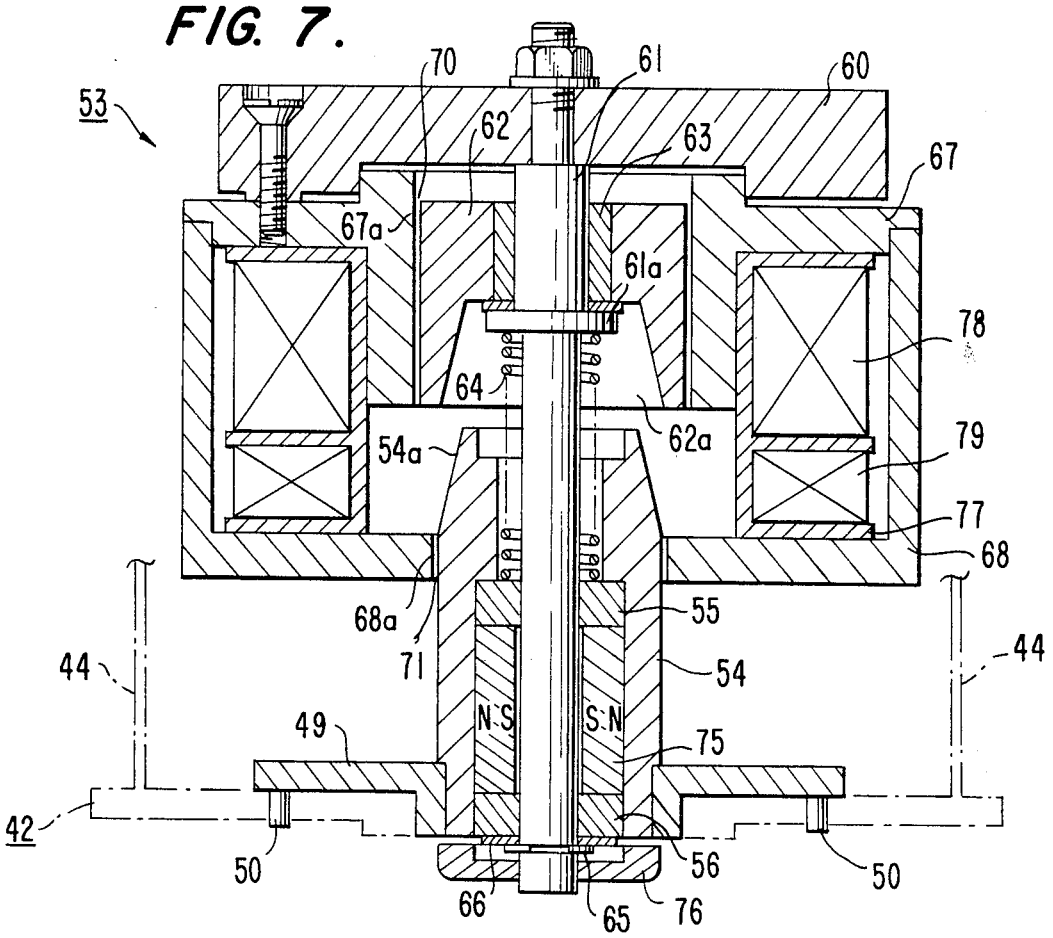
FIG. 7 is a sectional side view of another modified embodiment of the invention.

Next, explanation will be given on still another modified embodiment of the invention in accordance with FIGS. 7 through 9, in which the components functioning as the same as those in FIG. 2 are designated by the same reference numerals and duplicative description thereof is omitted. In FIG. 7, a shaft 61 is formed of a magnetic material and oily slide bearings 55, 56 and 63 are formed of sintered magnetic metal, a cylindrical magnet 75 radially magnetized is provided within the center of plunger 54, a shifting coil 78 and a resetting coil 79 are wound on a bobbin 77, a cap 76 of magnetic material being mounted to the lower end of shaft 61, and the plunger 54 is held stationary at the restoration position by means of coil spring 64, its weight, and a magnetic force (to be discussed below).

Figure 8:
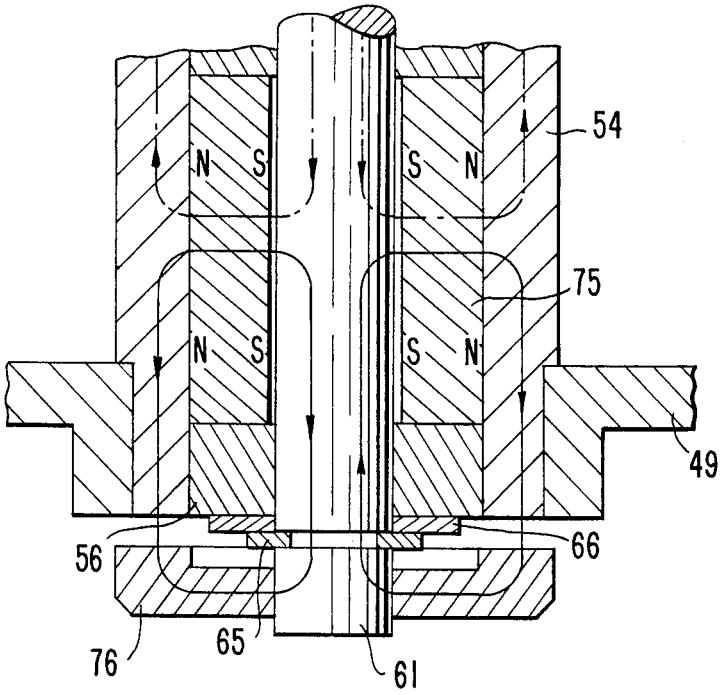
FIGS. 8 and 9 are partially enlarged side views explanatory of the operation of the FIG. 7 embodiment.

FIG. 8 shows the line of magnetic flux generated by the permanent magnet 75 when the plunger 54 is in the restoration position. Since the magnetic flux generated from the permanent magnet 75 in part passes through the magnetic circuit of permanent magnet 75-plunger 54-cap 76-shaft 61-permanent magnet 75 as shown by the solid line in FIG. 8, the plunger 54 is subjected to a downward force. Also, there is magnetic flux leakage to other magnetic circuits as shown by the one-dot chain line in FIG. 8. The cap 76 is adjustable in its shape or its distance from the plunger 54, thereby enabling adjustment of a force to hold the plunger 54 in the restoration position.

Here, when the plunger 54 is in the lowermost restoration position, the shifting coil 78 is energized to generate the magnetic flux in the magnetic circuit of yoke 68-plunger 54-rotator 62-yoke 67 so that the plunger 54 is subject to an upward force and attracted by the electromagnetic force to the rotator 62.

Figure 9:
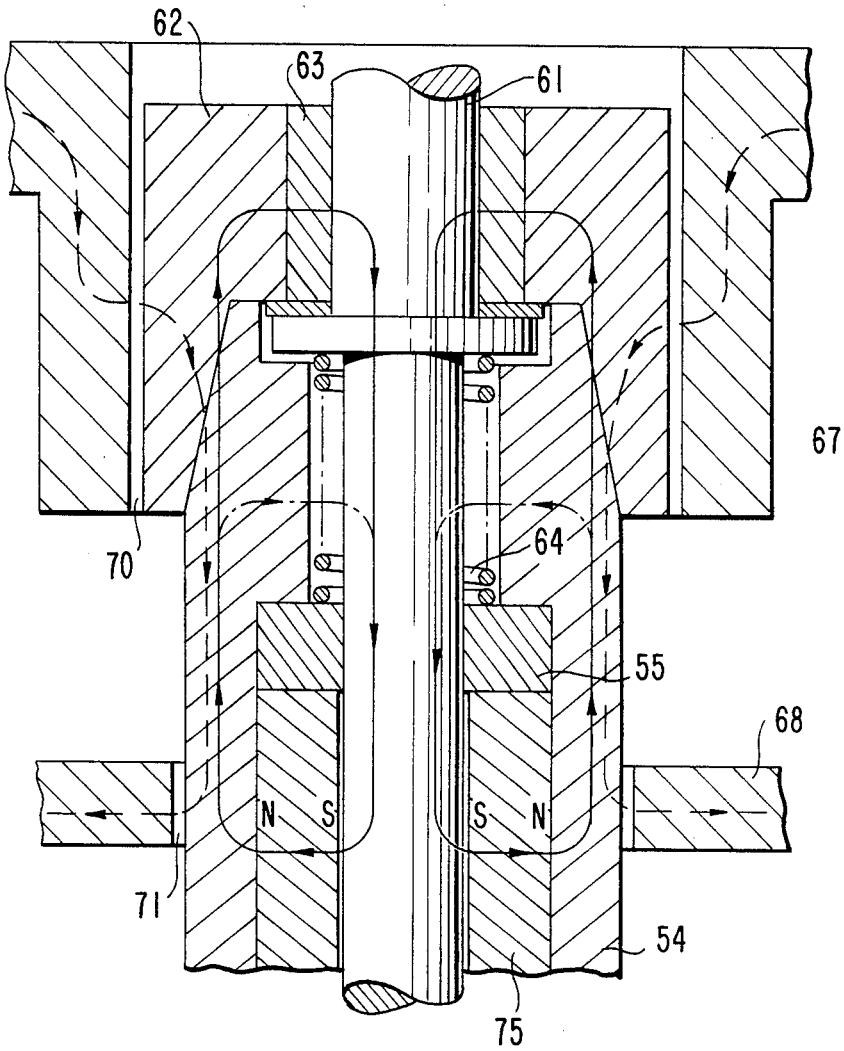

FIG. 9 is a view showing an example of the plunger 54 being attracted to the rotator 62 by the magnetic flux generated by the permanent magnet 75 as shown by the solid line.

Upon energizing the resetting coil 79, the magnet flux shown by the broken line in FIG. 9 is generated to cancel part of the magnetic flux generated from the permanent magnet 75, the magnetic flux in part bypassing the rotator 62 whereby the attraction of rotator 62 to the plunger 54 vanishes and the plunger 54 lowers by its weight and coil spring 64 to be restored.

The embodiment shown in FIGS. 7 through 9, as the former embodiment, can miniaturize the shifting mechanism and improve the reliability. Also, the load an the motor rotating the print element is reduced since the electric energy for keeping the shifting condition is saved.

Furthermore, since the magnetic circuit includes a bypass when the device is reset, the exciting force for resetting can be reduced, and the coils used only for shifting and resetting are provided, whereby the solenoid of the invention is advantageous in that it is usable by a single supply voltage.

In addition, the sintered material used for the rotator's bearing in the embodiment may be replaced by a material such as a thin resin plate.

Although several embodiments have been described, they are merely exemplary of the invention and not to be constructed as limiting, the invention being defined solely by the appended claims.

What is claimed is:

1. A solenoid device, comprising:

(a) a magnetic rotator having a rotational axis and a cylindrical outer peripheral rotator surface symetrically disposed about said rotational axis;

(b) a plunger, movable along said axis between a first position in which said plunger is spaced from said rotator by a first predetermined distance and a second position in which said plunger is spaced from said rotator by a second predetermined distance less than said first predetermined distance, said plunger having a cylindrical outer peripheral plunger surface symetrically disposed about said rotational axis;

(c) first and second magnetic yokes, having respective cylindrical inner first and second yoke surfaces symetrically disposed about said rotational axis spaced by respective first and second cylindrical gaps of predetermined first and second constant gap thicknesses from said rotational surface and said plunger surface, located sufficiently close to said rotator and said plunger at said rotator surface and said plunger surface, respectively, so as to form with said rotator and said plunger a magnetic circuit;

(d) support means for rotatably supporting said rotator and said plunger respectively spaced from said first and second yokes by said first and second gap thicknesses; and (e) magnetic flux generating means for generating magnetic flux in said magnetic circuit such that said plunger is moved by magnetic attraction from said first position to said second position.

2. A solenoid device as in claim 1, wherein said first and second yokes form together a hollow cylindrically shaped composite yoke having closed first and second axial ends and having respective first and second axial through bores therein respectively bound by said cylindrical rotator and plunger surfaces, said magnetic flux generating means comprising a coil disposed in said composite yoke between said first and second axial ends, said rotator and said plunger having axial holes therein, said support means including a shaft extending through said axial holes and said axial through bores and a fixing member fixing said shaft at a predetermined distance from said composite yoke.

3. A solenoid device as in claim 1, wherein said rotator has an outwardly tapered recess for receiving said plunger therein when said plunger is axially moved from said first position to said second position, said plunger having a tapered end for mating with said recess in said second position.

4. A solenoid device as in claim 1, further comprising means, including a spring, for biasing said plunger away from said second position toward said first position.

5. A solenoid as in claim 7, wherein said flux generating means comprises means, including first and second coils energizable to generate magnetic fluxes in said magnetic circuit in respectively opposite directions, for shifting said plunger from said first position to said second position in response to energization of said first coil and for shifting said plunger from said second position to said first position in response to energization of said second coil.

6. A solenoid device as in claim 1, further comprising means for causing the magnetic flux in said magnetic circuit to bypass said rotator.

7. A solenoid device as in claim 1, further comprising means, including a permanent magnet for generating a magnetic flux between said rotator and said plunger when said plunger is in said second position, thereby holding said plunger at said second position.

8. A solenoid device as in claim 7, wherein said magnetic flux generating means comprises means, including one coil, responsive to the direction of a current flowing in said one coil, for shifting said plunger from said first position to said second position and to shift said plunger from said second position to said first position.

9. A solenoid device as in claim 7, wherein said shaft is formed of a magnetic material, said permanent magnet being cylindrical and radially magnetized, said permanent magnet being disposed at the outer periphery of said shaft and fixed to said plunger so as to move along said shaft integrally with said plunger.

10. A solenoid device as in claim 7, wherein said permanent magnet is magnetized in the direction of said axis and has one end face coupled with said yoke and another end face opposite said one end face, said device further comprising a ring-shaped magnetic member coupled to said another end face and having an inner periphery opposing said plunger outer peripheral surface at a predetermined spacing therefrom.

* * * * *